US006089310A

United States Patent [19]

Toth et al.

[11] Patent Number: 6,089,310

[45] Date of Patent: Jul. 18, 2000

[54] THERMOSTAT WITH LOAD ACTIVATION DETECTION FEATURE

[75] Inventors: Bartholomew L. Toth, St. Louis; Ronald J. Holohan, Jr., Barnhart, both of Mo.

[73] Assignee: Emerson Electric Co., St. Louis, Mo.

[21] Appl. No.: 09/115,429

[22] Filed: Jul. 15, 1998

[51] Int. Cl.[7] ..... F25B 29/00

[52] U.S. Cl. ..... 165/11.1; 165/253; 165/259; 62/131; 62/127

[58] Field of Search ..... 62/131, 127; 165/11.1, 165/253, 259

[56] References Cited

U.S. PATENT DOCUMENTS

| | | | |
|---|---|---|---|
| 4,307,775 | 12/1981 | Saunders et al. | 62/127 |
| 4,384,844 | 5/1983 | Yamamoto et al. | 165/11.1 |
| 4,898,229 | 2/1990 | Brown et al. | 165/11.1 |
| 5,127,464 | 7/1992 | Butler et al. | 236/46 R |
| 5,363,667 | 11/1994 | Janke et al. | 62/131 |
| 5,579,648 | 12/1996 | Hanson et al. | 62/131 |
| 5,743,100 | 4/1998 | Welguisz et al. | 62/158 |

*Primary Examiner*—John K. Ford
*Attorney, Agent, or Firm*—Howell & Haferkamp, LC

[57] ABSTRACT

A thermostat for control of an AC-operated HVAC unit (or a unit providing only heating or only cooling) is provided with load activation detection sensing for increased reliability of latching relay activation. The thermostat includes a sensing transformer in series with the heating or cooling load (or both, if both are in the system), so that, when activation of the load is called for by the thermostat, current flows in a primary winding of the transformer, inducing a current in the secondary winding. A voltage derived from the current in the secondary winding is sensed by the thermostat controller and used to determine whether the heating or cooling load has been properly activated or deactivated. Sensing of the AC power source in the HVAC unit may also be provided, so that the controller can confirm that the absence of the voltage derived from the current in the secondary winding is actually due to the state of the latching relays rather than to a failure of the AC power source. When the sensed voltage derived from the current in the secondary winding does not correspond to that expected when the latching relays are in their expected states, the thermostat controller provides additional pulses, twice as long in duration as the original pulses and emitted at spaced intervals, to attempt to correct the fault by placing the relays into their correct states. Power for the thermostat controller may be derived, at appropriate times, from the current flowing in the secondary winding.

22 Claims, 5 Drawing Sheets

THERMOSTAT WITH LOAD ACTIVATION DETECTION FEATURE

BACKGROUND OF THE INVENTION

1. Field of the Invention

This invention relates to a thermostat with load activation detection, and to a method of controlling an HVAC system utilizing load activation detection.

2. Description of the Prior Art

Thermostats used for controlling HVAC systems typically control relays in the HVAC systems to operate heating loads and cooling loads without confirming whether the heating unit or the cooling unit, as the case may be, has actually responded when activated by the thermostat. Without the ability to confirm activation of the load, prior art thermostats are unable either to make repeated attempts to activate the heating or cooling unit, or to signal an actual failure of control. Failure of control will result in heating or cooling not actually being performed when needed, or heating or cooling continuing when it is not wanted. Aside from being wasteful in the latter case, failure of control may result in the environmental temperature becoming uncomfortable.

BRIEF DESCRIPTION OF THE INVENTION

It would therefore be desirable to provide a thermostat having means for sensing whether the heating or cooling unit has actually been turned on or off in response to a signal from the thermostat.

It would also be desirable to provide a thermostat having both the above-mentioned means for sensing as well as means for confirming the correctness of the sensing signal, when the means for sensing relies upon the absence of a signal to determine whether a heating or cooling unit is on or off.

It would also be desirable to provide a thermostat having the above-mentioned means for sensing (and preferably also the above-mentioned means for confirming) as well as means for utilizing AC power from the unit being controlled to power the thermostat.

It would also be desirable to provide a method of thermostatic control for an HVAC unit that provides greater reliability than existing thermostat units.

Accordingly, there is thus provided in a first inventive thermostat embodiment, a thermostat for an environmental temperature control system having an AC system power source, a temperature control load comprising one or more members of the group consisting of heating loads and cooling loads to which application of electrical power can he selectively applied through latching relay contacts, the thermostat being operatively coupled to the latching relays to selectively control the application of power from the AC system power source to the temperature control load or a portion thereof, the improvement comprising the thermostat having: an electrical sensor coupled to the load and generating a first indicator signal indicative of power being applied to the load; and a load sensing input and a load controlling output, the load sensing input being responsive to the first indicator signal for causing the load controlling output to pulse the latching relays until the sensed power applied to the load corresponds to that selected by the thermostat.

Preferably, the electrical sensor may comprise a transformer having a primary winding coupled in circuit with the temperature load and a secondary winding coupled to the load sensing input, the first indicator signal being representative of an amount of current in the secondary winding.

Also preferably, the thermostat is provided with a backup power source independent of the HVAC unit, such as a battery, and a thermostat input is provided that is responsive to an interruption or reduction of power provided by a power supply in the HVAC unit, so that the thermostat delays responding to the first indicator signal until AC power is restored to the HVAC unit. The thermostat input responsive to the interruption or reduction of power in the HVAC unit serves as confirmation that an expected absence of the first indicator signal is truly indicative of its intended meaning, rather than merely a consequence of failed power in tho HVAC unit. A perceptible alarm indication may be provided to indicate loss of power.

The thermostat unit also may optionally derive its normal source of power from the AC power source in the HVAC unit, and provide an alerting device to provide a perceptible indication of whether the temperature load is powered.

In accordance with another aspect of the invention, there is provided a thermostat for an AC-powered environmental control system comprising: a temperature sensor; a sensing transformer having a primary winding and a secondary winding, the primary winding being in circuit with a temperature load, so that when power to the temperature load is switched on, an alternating current flows through the primary winding to thereby induce a voltage across the secondary winding; and a controller coupled to the temperature sensor and configured to provide a signal to selectively switch power to the temperature load in response to the temperature sensor, the controller also being coupled to the secondary winding and configured to sense the voltage across the secondary winding to confirm the switching of power.

Preferably, the controller of the thermostat is configured to repeatedly provide, at some time interval, a signal to selectively switch power to the temperature load until the switching of power is confirmed by the sensed voltage across the secondary winding.

Also preferably, the thermostat is provided with a rectifier configured to rectify AC current from the environmental control system controlled by the thermostat, and a battery configured to provide uninterrupted current to the controller in the event of a failure of AC current drawn from the environmental control system. The controller is preferably provided with sensing means for sensing AC voltages at a pair of nodes, one of the pair of nodes being a node in circuit with the primary winding of the sensing transformer, and the other of the pair of nodes being a node in circuit with the secondary winding of the sensing transformer, the controller being responsive to the sensed voltages to delay generation of signal to selectively switch power to the temperature load.

There is also provided, in accordance with another embodiment of the invention, a method for controlling an environmental temperature control system with a thermostat, the method comprising the steps of: pulsing a latching relay to control a temperature load to an operating state selected by the thermostat; sensing a current drawn through the temperature load to generate a signal indicative of an operating state of the temperature load; and repeating the pulsing step when the signal indicative of the operating state of the temperature load indicates a state other than the selected operating state.

Preferably, the sensing step comprises inserting a primary winding of a transformer in series with a switched source of AC power to the temperature load and inducing a current in the secondary winding of the transformer, the current in the secondary winding of the transformer thereby being the signal indicative of the operating state of the temperature load.

Also preferably, when the thermostat is provided with an independent source of power to maintain uninterrupted operation, the thermostat performs the additional steps of sensing the presence of switchable AC power in the environmental control system, and delaying the step of repeating the pulsing step, when the switchable AC power has failed, until the switchable AC power has been restored.

The thermostats of the present invention can provide means for sensing whether the heating or cooling unit has actually been turned on or off in response to a signal from the thermostat.

The thermostats can also have means for confirming the correctness of a sensing signal provided by the sensing means, when the means for sensing relies upon the absence of a signal to determine whether a heating or cooling unit is on or off.

The thermostats of the present invention can utilize AC power from the HVAC unit being controlled to power the thermostat.

Thus, the thermostatic control for an HVAC unit of the present invention can provide greater reliability than existing thermostat units.

These and other features and advantages of the various embodiments of the invention will be apparent to those skilled in the art from the drawings and of the detailed description of the preferred embodiments appearing below.

DETAILED DESCRIPTION OF THE PREFERRED EMBODIMENTS

In the description and claims set forth herein, the term "environmental temperature control system" can refer to an HVAC system or unit, or a system or unit for cooling or for heating only. A "temperature load" is used to refer to a device such as a gas valve, a compressor contactor, or a relay controlling an electric heater, or to any other device or apparatus controlled by the thermostat for effecting a temperature change or to a selected one of a combination of such devices present in an HVAC system, insofar as such devices in a system are controlled by the thermostat. Also, where a device, circuit, or input is said to be responsive to a particular signal, whether a voltage signal or a current signal, unless otherwise noted, it is understood that one skilled in the art would understand that such signals may, as a design choice, be transformed or conditioned, or other equivalent signals generated that operate and are used as a functional equivalent to the particular signal named. The use of such transformed, conditioned, or equivalent signals should be understood as being within the scope and spirit of the invention and also be considered, where applicable and appropriate, as falling within the scope of the claims, either literally or by equivalence.

Figure 1:
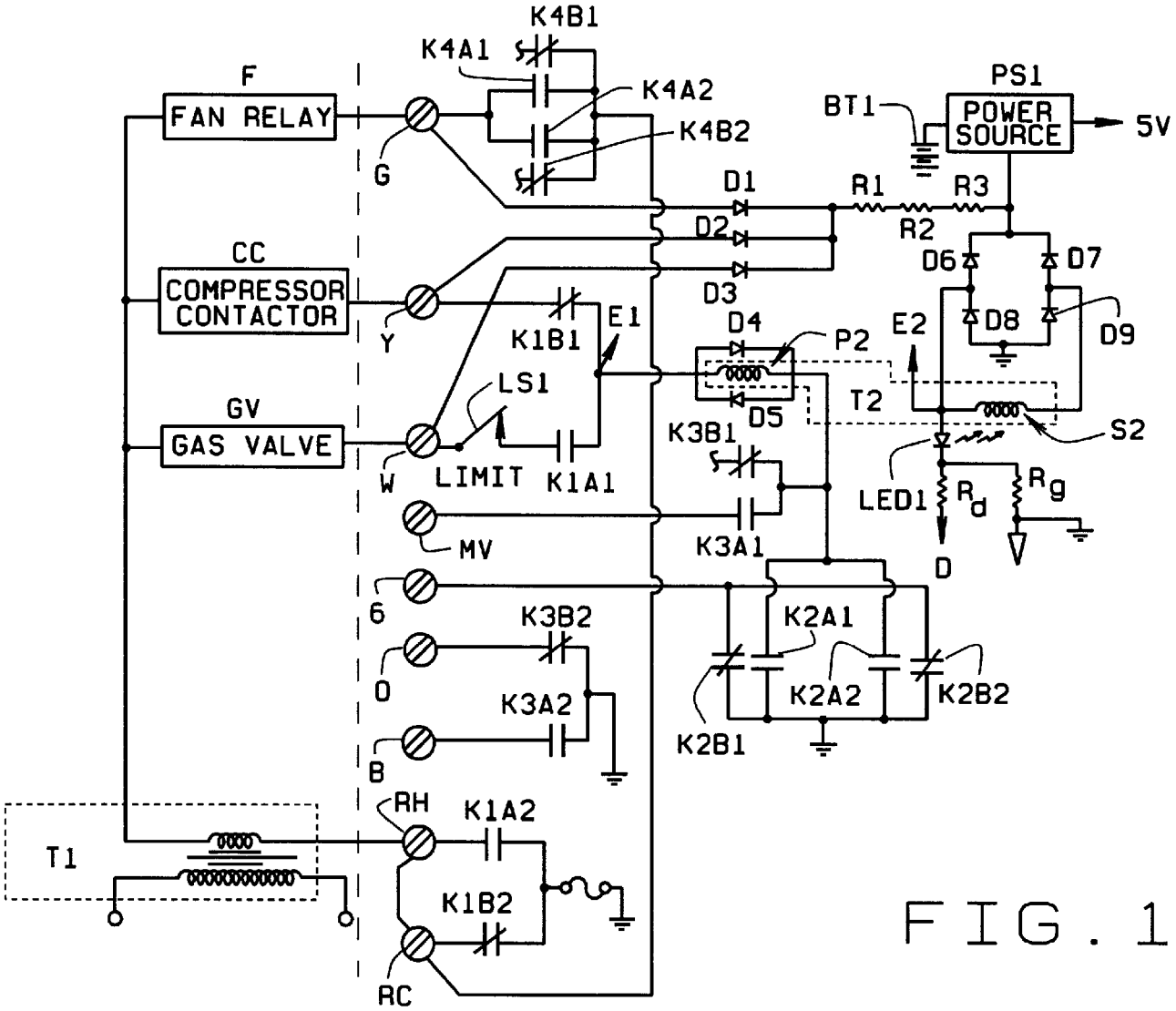
FIG. 1 is a simplified block diagram of part of an HVAC system controlled by the thermostat of the present invention showing electrical connections for portions of the thermostat to the HVAC unit.

FIG. 1 is a simplified block diagram of part of an HVAC system controlled by the thermostat of the present invention showing electrical connection of portions of the thermostat with the HVAC unit. AC power for switching the HVAC system is provided from a 120 VAC source through system power transformer T1, which typically provides a secondary voltage of 24 VAC. The power supply voltages represent a typical design choice made by designers of HVAC systems. The practice of the invention does not depend upon this voltage choice, however, and other voltages could be accommodated if necessary. Selection of heating or cooling is performed by opening and closing latching relays K1A1, K1A2, K1B1, and K1B2, where "K1" indicates a portion of relay K1, "A" indicates a "set" portion of the relay, and "B" indicates a "reset" portion of the relay. Typically, a "SET" coil (such as those shown at K1A, K2A, K3A, and K4A in FIG. 2) is energized by a DC pulse lasting approximately 7 milliseconds. When coil K1A is energized for 7 milliseconds, the K1A1 and K1A2 contacts will close and the K1B1 and K1B2 contacts will open. More specifically, if HEAT mode is selected by controller U1 (preferably a microcontroller), SET coil K1A is energized for 7 ms, closing contacts K1A1 and K1A2 and opening contacts K1B1 and K1B2. When contacts K1A1 and K1B2 are closed and contacts K1B1 and K1B2 are open, gas valve GV may be operated to allow heating to take place in the system of FIG. 1. An electric heat system would be selected in a similar way. If there is then a call for heat, SET coil K2A is energized for 7 milliseconds (ms), closing contacts K2A1 and K2A2, and opening contacts K2B1 and K2B2. On the other hand, if contacts K1A1 and K1A2 are open and contacts K1B1 and K1B2 are closed, compressor contactor CC may be operated to allow cooling to take place. A limit switch LS1 is conventionally provided in the heater control to prevent heating from occurring above a certain temperature, irrespective of the setting of the thermostat. A fan relay F is also conventionally controlled by additional relay contacts K4A1, K4B1, K4A2, and K4B2. It will be understood that some variation in the circuitry described thus far may occur in any given system, and that accommodation of such variation may require obvious design choices to made to the embodiment described here in order to practice the invention. It should be noted with respect to the latching relays, that once the latching relay is pulsed, it stays in either the "set" portion of the relay or "reset" portion of the relay until it is pulsed again. No current flows to the latching relay between application of the pulses.

In accordance with the practice of this invention, a step-up transformer T2 having a primary P2 and a secondary S2 is inserted in circuit with compressor contactor CC and gas valve GV (or electric heater), so that, whenever either gas valve (or electric heater) GV or compressor contactor CC draws current, and only when such current is drawn, a current is induced in secondary S2. In a typical application, primary winding P2 would be capable of handling about 1 Ampere of AC current at about 0.5 volts, and secondary winding S2 would provide a voltage step-up to about 7 to 8 volts. These voltages and currents are not critical to practice the invention, but are design choices selected in this embodiment for compatibility with other common circuit components. In the configuration of FIG. 1, primary P2 must be capable of handling all the current necessary to operate either gas valve or GV (or electric heater) or compressor contactor CC, depending upon which of these is turned on, without significantly changing the voltage being applied to either. Diodes D4 and D5 are preferably shunted across P2 to limit the magnitude of the voltage across P2.

In addition to transformer T2, and in accordance with another aspect of the invention, diodes D1, D2, and D3 are provided to supply operating power to the thermostat under certain conditions. Diodes D1–D3 obtain power from terminals G, Y, an W of the HVAC system, at least one of which will be at a potential supplied by the secondary of power transformer T1 when neither the compressor contactor CC nor the gas valve GV (or electric heater) is activated. In the event that the system is designed only for heating or only for cooling, it will be understood that the corresponding diodes of the group D1–D3 are not necessary and may be omitted from the circuit. Currents through diodes D1–D3 are rectified thereby and pass through a dropping resistance (in this embodiment, a series of resistors R1, R2, R3). The rectified current is used to power a conventional power source/regulator PS1 that provides the thermostat with power.

When either the compressor or gas valve (or electric heater) is on, the fan relay will also be on, either because it will have been turned on manually, or by the thermostat (in the cases in which the compressor is operating or an electric heater is controlled), or by the furnace (in the case of a gas heater). This mode of operation is conventional in HVAC units, but when this occurs, none of diodes D1–D3 will be supplying power to PS1 because all of terminals G, Y, or W will be effectively grounded, or at least the voltages that can be obtained from these terminals will be reduced due to current flowing in their respective loads. In this case, the AC current induced in secondary S2 of transformer T2 is sufficient to provide current to the rectifier circuit comprising diodes D6–D9, and the resulting rectified current is used by power source/regulator PS1 to power the thermostat. Power source PS1 may be provided with transient filtering to smooth out transients that may occur when power application to power source PS1 is switched between diodes D1–D3 and diodes D6–D9. A conventional battery back-up BT1 is also provided as an independent power source to maintain thermostat settings and clock time in the thermostat in the event of a failure of the AC power for switching the HVAC unit, or in the event of some other failure of the system, but power from battery BT1 is not needed during normal operation of the thermostat in the preferred embodiment described here.

Figure 2:
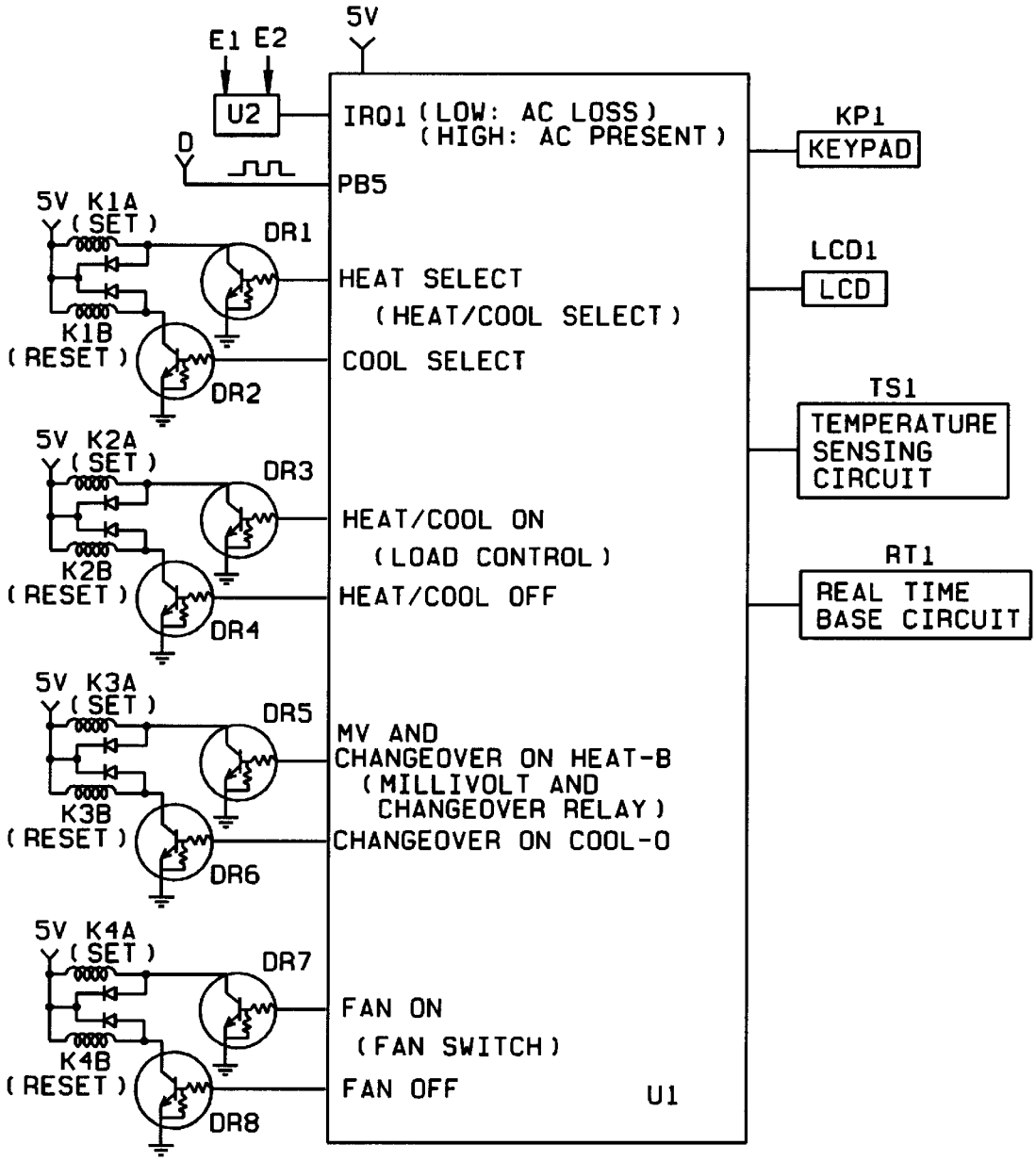
FIG. 2 is a block diagram of an embodiment of a processor unit of a thermostat in accordance with the present invention.

FIG. 2 is a block diagram of an embodiment of a processor unit of a thermostat in accordance with the present invention. Controller U1 is preferably a conventional microcontroller with memory, which may itself comprise one or more chips. Controller U1 is provided with conventional thermostat peripherals, including a keypad KP1 for the input of commands, an LCD display LCD1 for displaying the current status of the thermostat, a temperature sensing circuit TS1, and a real time-base circuit or real-time clock RT1. Controller U1 provides outputs for heat select (HS), cool select (CS), heat/cool on (HCON), heat/cool off (HCOFF), millivolt and changeover relay on heat-B (COH), changeover on cool-O (COC), fan on (FON), and fan off (FOFF). These operate driver amplifiers DR1–DR8, respectively, which, in turn, control relay coils K1A (set), K1B (reset), K2A (set), K2B (reset), K3A (set), K3B (reset), K4A (set) and K4B (reset), which are coils in the environmental temperature control system. It will be appreciated that not all of these outputs and driver amplifiers are necessary for the practice of the invention, nor are all used in the practice of the invention. However, driving circuits are shown in FIG. 2 to illustrate that the invention may be incorporated into a general purpose thermostat having additional control functions, as well as thermostats designed for replacement use to control a variety of systems.

Operation of the thermostat of FIG. 2 is conventional (in that activation of fan F, gas valve GV, and compressor contactor CC is controlled in accordance with a sensed temperature and the controller settings) except that feedback is provided to permit controller U1 to detect and correct certain error conditions. In particular, U1 is provided with an input PB5 that is provided with a voltage from point D of the circuit of FIG. 1. Controller U1 is also preferably provided with another input IRQ1 that receives a signal that is a function of voltages present at points E1 and E2 of the circuit of FIG. 1.

Returning to FIG. 1, when an AC voltage is present on at least one of terminals G, Y, or W, current is applied through resistors R1, R2, and R3 to power source PS1 and to the cathodes of diodes D6 and D7. When the resulting voltage, which is positive, is applied to the cathode of diodes D6 and D7, none of diodes D6–D9 conducts, and there is no available current to turn on light emitting diode LED1. In addition, node D, to which input PB5 of controller U1 is connected, is essentially at ground potential. On the other hand, when the heating or cooling load is turned on, an AC current is induced across secondary S2 of sensing transformer T2. When this occurs, either D6 or D7 (at different times during the AC cycle) will conduct to provide rectified power to power source PS1 for operation of the thermostat. In addition, a rectified AC current (i.e., a pulsating DC current) will flow through LED1, causing LED1 to light. This current will also flow through current limiting resistor $R_g$, generating a pulsating DC voltage that is coupled by $R_d$ to controller input PB5. Preferably, this voltage pulsates from 0 to +5 volts, but the circuit may be configured so that the range is between any two other values that may be suitably detected and distinguished by controller U1. The presence of the pulsating DC voltage, which varies at a slow rate related to the power supply frequency, is easily detected by controller U1 with suitable programming. Of course, further processing may be performed on the pulsating DC signal to convert it to any other type of signal that is suitable for application to an input of controller U1 and that is indicative of the presence of the pulsed DC voltage before it is applied to the input of the controller. Variations such as this represent design choices well within the range of skill in the art, and will not be further considered here except to mention that some corresponding minor changes to the programming of controller U1 may be required to accommodate the variations.

Also preferably, voltages present at nodes E1 and E2 of FIG. 1 are coupled to input IRQ1 of controller U1 in a manner now to be discussed. Nodes E1 and E2 (or functionally equivalent nodes) are selected because an AC voltage is present on node E1 when neither the gas valve GV nor the compressor contactor CC is activated (or, if only one load is present in the system, it is not activated). Node E2 is located at a point at which AC voltage is present only when either the heating or cooling load is on, and in this embodiment, is a node at one end of the secondary of sensing coil S2. It will be noted that the AC voltage at E1 drops to zero when current is flowing past node E1, but that when this happens, the same current causes an AC voltage to appear at node E2. These pulses are combined in some suitable manner by a circuit U2 that provides a pulsed output signal (or some other suitable signal) indicating that a pulsed AC voltage is present at either node E1 or E2. This indicator signal is applied to input IRQ1 of controller U1.

It will now be evident that controller U1 can easily deject certain failures of the HVAC system from the presence or absence of pulses at inputs PB5 and/or IRQ1 as follows. When a heating or cooling load is turned on, current flowing through the primary P2 of sensing transformer T2 induces an AC current through secondary S2, causing LED1 to light and providing a pulsed DC signal at input PB5, which is detected by a program running in controller U1. If the program logic expects, but does not detect, the pulsed DC signal at input PB5, the program can cause controller U1 to take appropriate corrective action, such as making one or more additional attempts to turn on the load and/or signaling the error condition on the LCD display or via any other conventional signaling means. The program may also detect the presence of AC power in the HVAC unit by sensing the presence of the indicator signal applied to IRQ1 of controller U1. If AC power is not present, an error indication should be provided at the thermostat, since control of the HVAC unit is not possible without the availability of AC power. In addition, attempts by the thermostat to control the HVAC unit can be delayed by the program and repeated when the program senses that AC power is available again. (Additional attempts to control these relays are necessary because HVAC control relays are typically latching relays that respond to short control pulses from the thermostat. These control pulses must be repeated to accomplish the desired control if the relays do not latch because AC power is not continuously applied to latching relays.) Furthermore, if AC power in the HVAC unit is not present, there will be no pulsed DC signal at input PB5, irrespective of whether such a signal is expected by program logic. If AC power has failed at a time when the pulsed DC signal at PB5 is expected to be present, it will serve no purpose to pulse the latching relays, and doing so would unnecessarily and prematurely deplete battery BT1. Therefore, input IRQ1 can be used to confirm that the absence of a pulsed DC signal at PB5 actually indicates a presently correctable fault condition, and to delay action to correct a fault if immediate corrective action would be futile.

Figure 3:
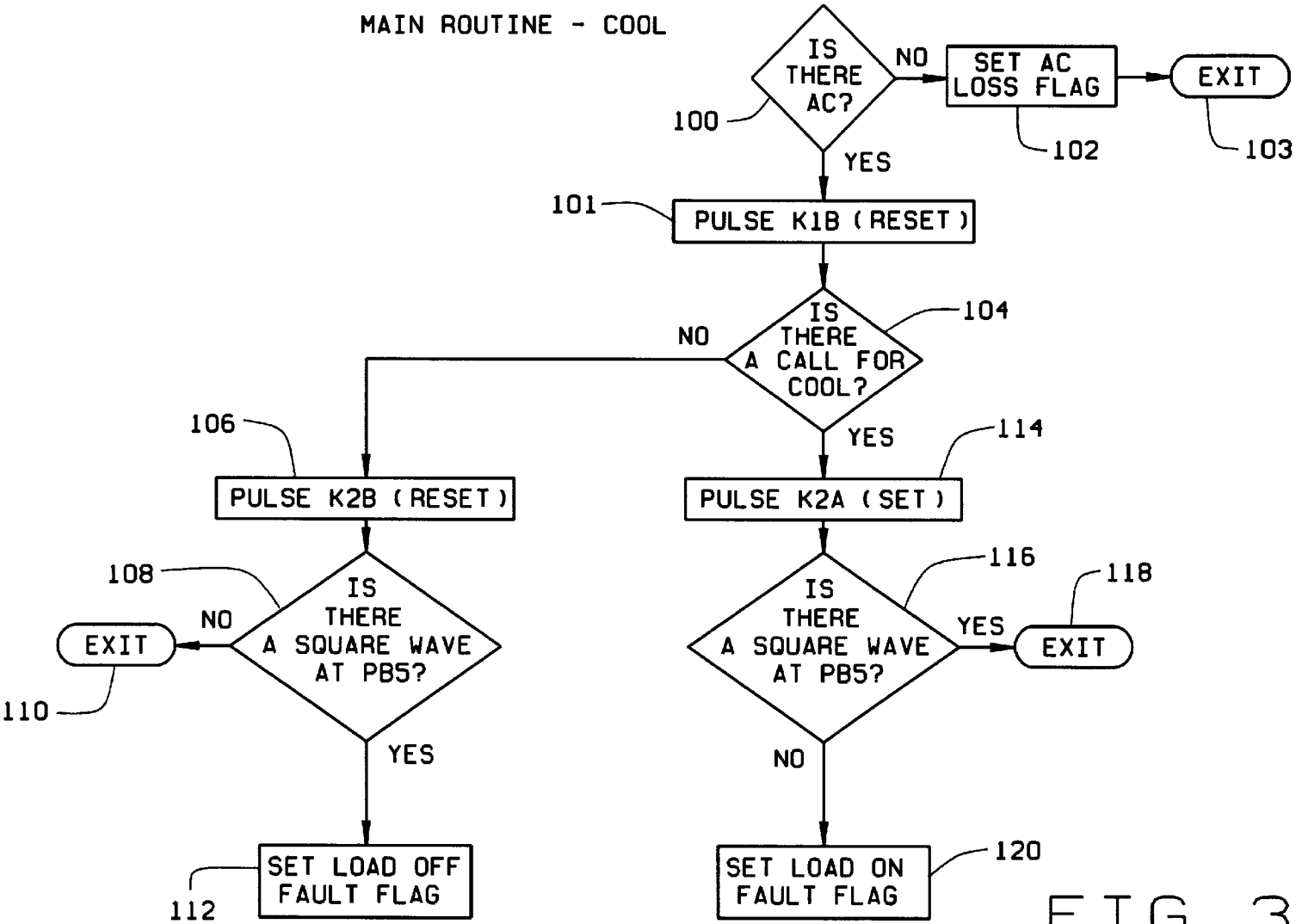
FIG. 3 is a flow chart of a cooling control routine for operating the controller of the inventive thermostat in accordance with the present invention.

Turning now to the flow chart of FIG. 3, the operation of a portion of a thermostat control program operating in accordance with the invention is now described. FIG. 3 is a flow chart of a cooling control routine for operating the controller of a thermostat that incorporates the present inventive concepts. The routine is entered at decision block 100, where it is determined whether AC power is present by checking the indicator signal at IRQ1. If it is determined that AC power is not present, an "AC loss" flag is set at block 102, and the routine is exited at block 103, because there is no point in attempting to control the cooling unit in the absence of AC power in the HVAC relays. It should be noted that, while testing for AC power is desirable, the test is not essential to the invention. Furthermore, the program performing this test may be structured somewhat differently from that shown here. For example, the test for AC power may occur outside the cooling routine. Also, rather than set a flag, the routine could simply enter a loop (possibly including a delay) that continues to check for AC power, exiting when AC power is present. An alarm may also be indicated in a suitable way, such as an alarm indicator on LCD display LCD1 of FIG. 2, or perhaps some other visual or audible alarm (not shown). These types of variations are considered mere design choices that could be made by one skilled in the art, and are not critical to the practice of the invention.

Assuming that AC power is present, reset relay coil K1B is pulsed at block 101 to select the cool mode. The routine next checks to determine whether there is a call for cooling, such as would occur either if the thermostat temperature setting has been exceeded or a command to switch the cooling load on has been entered into the thermostat. If not, the reset relay K2B is pulsed at block 106. Preferably, the pulse sent to K2B is 9 ms, which is somewhat longer than absolutely necessary to provide a margin of reliability to ensure that the load is turned off. Next the routine checks to determine whether there is a pulsed DC signal (or, as mentioned above, some other signal indicative of the presence of a pulsed DC signal) present at input PB5. The absence of this signal is considered a confirmation that the cooling load is, or has been turned off, so the routine exits at this point through block 110 if the signal is not indicated or determined to be present. On the other hand, if the pulsed DC signal has not been turned off, this is taken as an indication that contacts K2A1 and K2A2 did not open as expected. In this case, the routine continues to block 112 where the routine concludes by setting the LOAD OFF FAULT flag. (In a variation of the routine shown here, as a design choice, the routine could simply loop back, preferably after a suitable delay, to perform the test at block 108 again. It goes without further mention that one skilled in the art would be capable of recognizing other similar changes in the routines described here, so this type of variation will not be further mentioned.)

Returning to block 104, if a call for cooling has been made, execution continues at block 114, where relay coil K2A (the "set" coil) is pulsed for 7 ms, which should be more than enough time to energize the latching relay K2. (Typically, 2 or 3 ms should be sufficient, but 7 ms provides a margin for greater reliability.) Execution then proceeds to decision block 116, where a test similar to that performed in block 108 is performed. This time, however, if a pulsed DC signal (or its indicator signal) is present at PB5, the presence of the signal is expected as an indication that the cooling load has actually been turned on, so the routine exits at block 118. On the other hand, if the routine finds that the signal (or its indicator) is absent, this is taken as an indication that relay contacts K2A1 and K2A2 have not closed as expected, so execution continues at block 120, where a LOAD ON FAULT flag is set.

Figure 4:
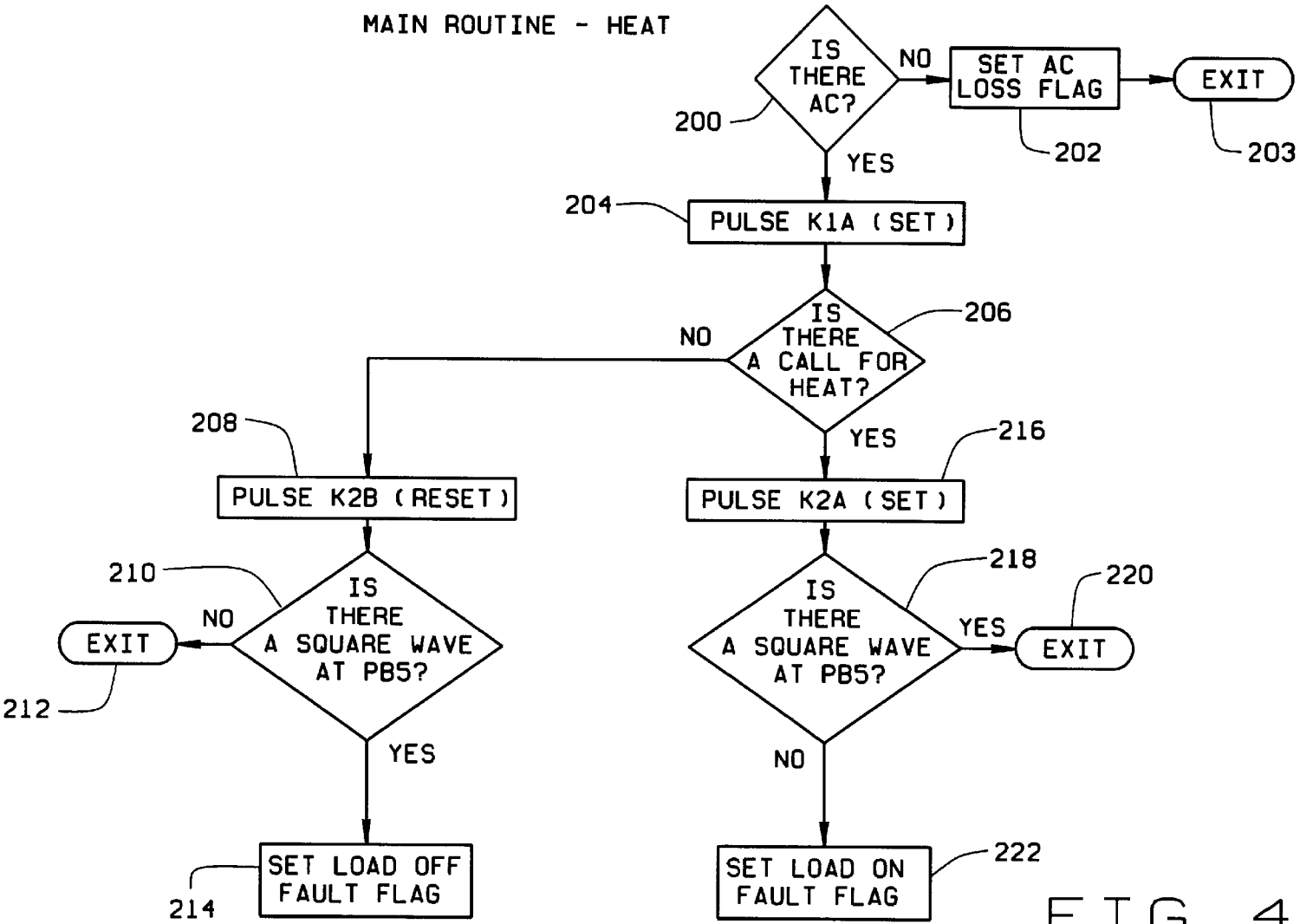
FIG. 4 is a flow chart of a heating control routine for operating the controller of the inventive thermostat in accordance with the present invention.

Similar execution steps are illustrated in the flow chart for heating shown in FIG. 4. The routine is entered at decision block 200, which, together with the flag setting block 202 and exit block 203, perform the same functions as decision block 100, flag setting block 102, and exit block 103 in FIG. 3. If there is AC power, set relay coil K1A is pulsed at block 204 to select the heat mode. Next, the test in decision block 206 is performed. If there is no call for heat, control branches to block 208. Blocks 208, 210, 212, and 214 perform the same functions as blocks 106, 108, 110, and 112, respectively, in FIG. 3, and as such, should need no further description. On the other hand, if there is a call for heat, control branches from decision block 206 to block 216. Blocks 216, 218, 220, and 222 perform the same functions as blocks 114, 116, 118, and 120 in FIG. 3, and should likewise need no further description.

It will be understood by those skilled in the art that either the cooling or the heating routines may be employed without implementing the other, particularly if the thermostat is used or designed to control only a cooling load or a heating load.

Also, because the inventive thermostat is not designed to implement the load activation detection feature when used in millivolt heating systems, the heating routine may be omitted or a function may be provided to bypass the heating routine in cases in which the thermostat is used to control an HVAC unit with a millivolt heating system.

Figure 5:
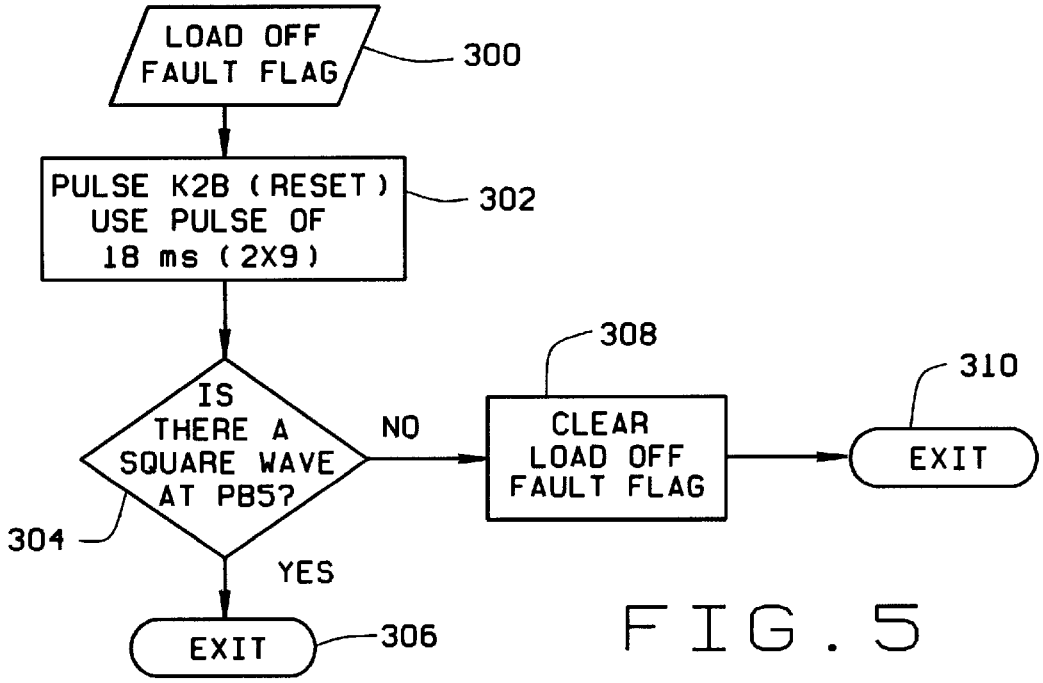
FIG. 5 is a flow chart of a routine to be executed periodically for operating the inventive thermostat whenever a LOAD OFF FAULT condition flag is set.

FIG. 5 is a flow chart of a routine, for operating the controller of the thermostat, that is to be executed periodically whenever the LOAD OFF FAULT flat is set. It is contemplated by the inventors that this routine would be executed every five minutes, but any other suitable repeat interval (regular or irregular) could be selected as a design choice by one skilled in the art. The LOAD OFF FAULT routine is entered at block 300. At block 302, relay coil K2B (RESET) is pulsed for 18 ms (i.e., twice as long as the usual pulse of 9 ms). While application of a 9 ms pulse may be sufficient, at least doubling the length of the pulse is preferred to increase the probability of fault recovery by this routine. Next, it is determined, at decision block 304, whether the load has been turned off by testing for an indication of pulsed DC voltage (or other indicator) at PB5. If the pulsed DC voltage (or its indicator) is present, it is presumed that the load is still on despite the attempt to turn it off in block 302. The routine then simply exits at block 306, indicating a failure of recovery from this error condition. In this case, the LOAD OFF FAULT flag is not cleared, and the routine in FIG. 5 will execute again after expiration of the repeat interval. On the other hand, if the pulsed DC voltage (or its indicator) is absent, this is presumed to be a result of the load being turned off in a successful recovery attempt at block 302. In this case, the LOAD OFF FAULT flag is cleared at block 308, and the routine exits at block 310. Because the LOAD OFF FAULT flag is cleared, execution of the routine need not be repeated until the flag is again set.

Figure 6:
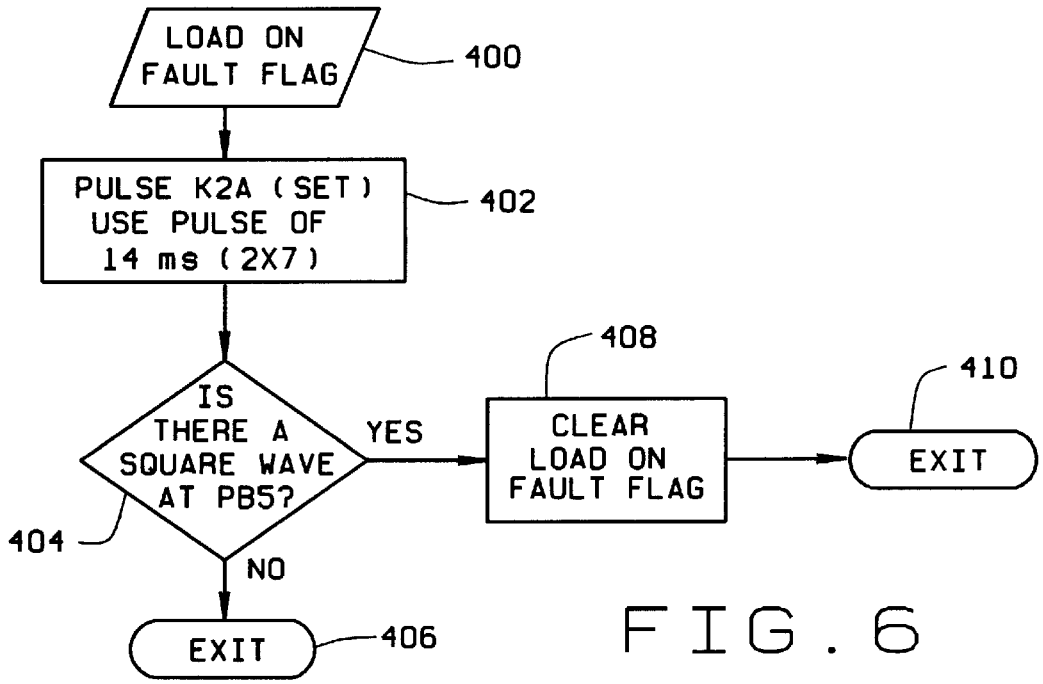
FIG. 6 is a flow chart of a routine to be executed periodically for operating the inventive thermostat whenever a LOAD ON FAULT condition flag is set.

FIG. 6 is a flow chart of a corresponding routine to be executed if the LOAD ON FAULT flag is set. It is also contemplated that this routine be executed every five minutes, although other repeat intervals (regular or irregular) may be chosen for this routine, as with the previously described routine, as a design choice by one skilled in the art. The routine is entered at block 400. At block 402, relay coil K2A (SET) is pulsed for 14 ms (i.e., twice as long as the usual 7 ms pulse). Again, such a longer pulse than usual is preferred for increased recovery probability, for the same reasons given with respect to the K2B coil and step 302 in FIG. 5. Next, it is determined, at decision block 404, whether the load has been turned on by testing for an indication of pulsed DC voltage (or other indicator) at PB5. If the pulsed DC voltage (or its indicator) is absent, it is presumed that the load is still off despite the attempt to turn it on in block 402. The routine then simply exits at block 406, indicating a failure of recovery from this error condition. In this case, the LOAD ON FAULT flag is not cleared, and the routine in FIG. 6 will execute again after expiration of the repeat interval. On the other hand, if the pulsed DC voltage (or its indicator) is present, this is presumed to be a result of the load being turned on in a successful recovery attempt at block 402. In this case, the LOAD ON FAULT flag is cleared at block 408, and the routine exits at block 410. Because the LOAD ON FAULT flag is cleared, execution of the routine need not be repeated until the flag is again set.

Although not shown in the figures, an additional routine is preferably provided that is executed at a repeat interval when the AC LOSS flag is set. This routine would simply check whether the AC present signal indication at IRQ1 is present, and clear the AC LOSS flag if it is. Then, either the cooling routine of FIG. 3 or the heating routine of FIG. 4 would be reentered for appropriate recovery of the system at a time when its execution would not be futile.

By reference to FIG. 1, it should be observed that AC power may be present in the HVAC unit (i.e., at terminal G), but absent, due to some wiring or other fault, at both nodes E1 and E2. It will be seen, therefore, that the AC LOSS flag (desirably) may be active when there is a loss of only AC control voltage for the heating and cooling loads (or either, if only one is present), without there being a complete loss of AC control voltage for the system as a whole. Alternately, or in addition to the AC LOSS flag, controller U1 could be provided with circuit means to detect whether current is being drawn by backup battery BT1 to determine whether AC power has been lost. This check would not necessarily indicate a fault caused by loss of AC voltage controlling the cooling and/or heating loads, if, for example, an AC voltage is still present at terminal G. Neither the check of nodes E1 and E2 nor the backup battery drain check is required for practice of the invention, but are optional for purposes of increased fault detection reliability.

Various modifications to the above-described circuits and programs are possible within the spirit of the invention. Many such modifications will be apparent to those skilled in the art. Therefore, the scope of the invention should be not be considered as being limited solely to the embodiments described above. For determination of the scope of the invention, reference should be made to the claims appended below, including the full range of equivalents as provided by law.

What is claimed is:

1. A thermostat for an environmental temperature control system having an AC system power source, a temperature load comprising one or more members of the group consisting of heating loads and cooling loads to which electrical power from a low voltage side of the AC system power source can be selectively applied through latching relays, the thermostat being operatively coupled to the latching relays to selectively control the application of power from the low voltage side of the AC system power source to the temperature load, the improvement comprising the thermostat having:

a sensor coupled to the temperature load and generating a first indicator signal indicative of power being applied to the load; and a controller having a load sensing input and a load controlling output, the load sensing input being coupled to the first indicator signal for causing the load controlling output to pulse the latching relays when the sensed power applied to the load does not correspond to that selected by the thermostat.

2. The thermostat of claim 1 wherein the sensor comprises a transformer having a primary winding coupled in a circuit with the temperature load and a secondary winding coupled to the load sensing input, and wherein the first indicator signal is representative of an amount of current in the secondary winding.

3. The thermostat of claim 2 wherein the first indicator signal comprises a rectified, pulsed DC signal derived from current in the secondary winding, and the controller determines whether the pulsed DC signal is present at the load sensing input.

4. The thermostat of claim 3 wherein the secondary winding is configured to supply operating power to the controller when current is induced in the secondary winding.

5. The thermostat of claim 2 and further comprising:

means for generating a second signal indicative of whether the AC system power source is supplying an AC voltage to the thermostat; and a controller power source for supplying operating current to the controller derived from the AC system power source and including a battery for supplying operating current to the controller when the AC system power source has failed, the controller being responsive to the second signal for delaying the response to the first indicator signal.

6. The thermostat of claim 5 wherein the means for generating a second signal is coupled to a first node in circuit with the secondary winding and also to a second node in circuit with the primary winding, the first and the second nodes being selected so that, when an AC voltage at the second node is reduced by current flowing in the temperature load, an AC voltage is produced at the first node sufficient for generating the second signal.

7. The thermostat of claim 6 wherein the temperature load comprises both a heating load an a cooling load, and the second node is in circuit between the temperature load and the primary winding.

8. The thermostat of claim 2 and further comprising:

a power supply for supplying power to the controller; and a first rectifier coupled to the controller power supply, and further wherein terminals of the environmental temperature control system are coupled to the rectifier so that an AC voltage at the terminals is rectified and the rectified voltage provides a source of power for the power supply.

9. The thermostat of claim 8 and further including a second rectifier coupled to the controller power supply, and wherein the secondary winding is coupled to the second rectifier, the transformer being configured to supply an AC voltage to the second rectifier when the voltage at the terminals is reduced while current flows through the temperature load.

10. The thermostat of claim 9 and further comprising a battery back-up power source supplying current to the power supply when the AC system power source has failed.

11. The thermostat of claim 2 and further comprising an alerting device responsive to current in the secondary winding to provide a perceptible indication of whether the temperature load is powered.

12. A thermostat for an AC-powered environmental temperature control system comprising:

a temperature sensor;

a sensing transformer having a primary winding and a secondary winding, the primary winding being in circuit with a temperature load, so that when power to the temperature load from a low voltage side of the AC-powered environmental temperature control system is switched on, an alternating current flows through the primary winding to thereby induce a voltage across the secondary winding;

a controller coupled to the temperature sensor and configured to provide a signal to selectively switch power to the temperature load in response to the temperature sensor, the controller also being coupled to the secondary winding and configured to sense the voltage across the secondary winding to confirm the switching of power.

13. The thermostat of claim 12 wherein the controller is further configured to repeat a generation of a signal to selectively switch power to the temperature load until the switching of power is confirmed by sensing of the voltage across the secondary winding.

14. The thermostat of claim 13 and further comprising a rectifier, the rectifier being configured to rectify AC current from the environmental control system controlled by the thermostat, and further comprising a battery configured to provide uninterrupted current to the controller in the event of a failure of AC current obtained from the environmental control system.

15. The thermostat of claim 14 and further comprising means for delaying the generation of a signal to selectively switch power to the temperature load when AC current in the environmental control system has failed.

16. A method for controlling an environmental temperature control system with a thermostat, and having a temperature load powered by a low voltage side of the environmental temperature control system, the method comprising:

pulsing a latching relay to control the temperature load to an operating state selected by the thermostat;

sensing a current drawn through the temperature load to generate a signal indicative of an operating state of the temperature load; and repeating the pulsing step when the signal indicative of the operating state of the temperature load is inconsistent with the selected operating state.

17. The method of claim 16 wherein the sensing step comprises providing inducing a current in the secondary winding of a transformer in series with a switched source of AC power to the temperature load, the current in the secondary winding of the transformer thereby becoming the signal indicative of the operating state of the temperature load.

18. The method of claim 17, further comprising:

supplying the thermostat with a source of power independent of the switched source of AC power to the temperature load;

sensing presence of switchable AC power in the environmental temperature control system; and delaying the pulsing step, when the switchable AC power has failed, until the switchable AC power has been restored.

19. The method of claim 17, wherein the sensing step comprises rectifying current in the secondary winding to generate a pulsed DC voltage, and applying the pulsed DC voltage to a controller, and wherein repeating the pulsing step comprises applying pulses to a latching relay in accordance with the presence or absence of the pulsed DC voltage.

20. The method of claim 19, wherein the presence or absence of the pulsed DC voltage is determined periodically by the controller, and the controller periodically generates a pulse when its determination of the presence or absence of the pulsed DC voltage is inconsistent with a required state of the temperature load.

21. The method of claim 20 wherein the periodically generated pulse is longer than a pulse, originally applied by the controller, and which failed to switch the temperature load to the required state.

22. The method of claim 17 further comprising supplying operating current to the controller from current induced in the secondary winding, when the induced current in the secondary winding is present.

* * * * *